US007726312B2

(12) United States Patent
Chapman et al.

(10) Patent No.: US 7,726,312 B2
(45) Date of Patent: Jun. 1, 2010

(54) HARNESSES

(75) Inventors: Aaron Chapman, Newcastle upon Tyne (GB); David Graham Storey, Newcastle upon Tyne (GB); Paul Townsend, Newcastle upon Tyne (GB)

(73) Assignee: Draeger Safety UK Limited, Blyth, Northumberland (GB)

( * ) Notice: Subject to any disclaimer, the term of this patent is extended or adjusted under 35 U.S.C. 154(b) by 0 days.

(21) Appl. No.: 10/812,495

(22) Filed: Mar. 30, 2004

(65) Prior Publication Data

US 2004/0200481 A1 Oct. 14, 2004

(30) Foreign Application Priority Data

Apr. 1, 2003 (GB) ..... 0307556.1

(51) Int. Cl.
*A62B 7/00* (2006.01)
*A62B 9/00* (2006.01)

(52) U.S. Cl. ..... 128/205.22; 128/200.24

(58) Field of Classification Search ..... 128/201.11, 128/201.26, 201.27, 202.27, 205.22, 870, 128/869, 875, 876; 405/186, 187; 182/3, 182/6; 24/3.1, 3.9
See application file for complete search history.

(56) References Cited

U.S. PATENT DOCUMENTS 3,670,509 A * 6/1972 Walters ..... 405/186
3,871,381 A * 3/1975 Roslonski ..... 607/104
4,054,132 A * 10/1977 Deeds ..... 128/202.14
4,377,163 A * 3/1983 Feathers ..... 128/205.22
4,434,793 A * 3/1984 Willits ..... 128/876
4,498,471 A * 2/1985 Kranz et al. ..... 128/204.26

(Continued)

FOREIGN PATENT DOCUMENTS

GB 2 251 544 A 7/1992

(Continued)

OTHER PUBLICATIONS

DMM Harness General User Instructions [online]. [Retrieved on Jun. 25, 2004] Retrieved from the Internet: <http/:www.dmmwales.com.

*Primary Examiner*—Steven O Douglas
*Assistant Examiner*—Annette F Dixon
(74) *Attorney, Agent, or Firm*—Sunstein Kann Murphy & Timbers LLP

(57) ABSTRACT

A harness for use with breathing apparatus has: a flexible hip plate 12 and a flexible bandolier-style shoulder panel 14, linked together by a strap 15, and a waist belt 16 fastenable by a sprung fastener. In use, the flexible hip plate 12 rests against the hip of a user (the left hip in this example), the waist belt is fitted around the waist of the user, and the shoulder panel 14 rests against the shoulder opposite to the hip against which the flexible plate is resting (the right shoulder in this example). At least the bandolier-style panel 14, and optionally also the hip plate 12 of the harness 10, are made of a resilient material which, though flexible, allows the harness substantially to retain its operational configuration even when not being worn. The material is preferably a composite, and may comprise closed cell, open face foam, such as compression moulded EVA foam. Two layers of such foam may be used in a sandwich construction, and may be glued or otherwise bonded together.

15 Claims, 5 Drawing Sheets

U.S. PATENT DOCUMENTS 4,685,456 A * 8/1987 Smart ..... 128/205.22
4,776,504 A 10/1988 Panth ..... 224/209
4,889,306 A * 12/1989 Boucher ..... 248/313
4,949,889 A * 8/1990 Carson ..... 224/270
4,979,659 A * 12/1990 Boyd ..... 224/603
5,022,790 A * 6/1991 Stevenson ..... 405/186
5,267,815 A * 12/1993 Feder ..... 405/186
5,394,870 A * 3/1995 Johansson ..... 128/205.22
5,421,326 A * 6/1995 Rankin et al. ..... 128/201.19
5,492,110 A * 2/1996 Lenz et al. ..... 128/202.22
5,540,368 A * 7/1996 Oliva ..... 224/271
5,584,289 A * 12/1996 Wise ..... 128/205.24
5,954,250 A * 9/1999 Hall et al. ..... 224/262
5,961,476 A * 10/1999 Betto et al. ..... 602/16
5,970,519 A * 10/1999 Weber ..... 2/81
6,003,744 A * 12/1999 Culjak ..... 224/148.5
6,030,147 A * 2/2000 Bowden ..... 405/186
6,041,778 A * 3/2000 Swann et al. ..... 128/201.25
6,120,213 A * 9/2000 Stinton ..... 405/186
6,354,295 B1 * 3/2002 Hasson, Jr. ..... 128/205.22
6,367,753 B1 * 4/2002 Berg ..... 248/222.11
6,405,728 B1 * 6/2002 Van Hall et al. ..... 128/205.22
6,520,176 B1 * 2/2003 Dubois et al. ..... 128/200.24
6,651,751 B2 * 11/2003 Kluczynski ..... 169/51
2001/0047904 A1 * 12/2001 Antonio ..... 182/3

FOREIGN PATENT DOCUMENTS

GB 2 252 490 A 8/1992
GB 2 258 390 A 2/1993

* cited by examiner

HARNESSES

FIELD OF THE INVENTION

The present invention relates to harnesses for use as part of breathing apparatus, such as self contained breathing apparatus used by operatives and others working in hazardous conditions.

BACKGROUND OF THE INVENTION

A number of known harnesses exist for use with breathing apparatuses, where the harness typically incorporates a rigid mounting plate or housing for receiving a cylinder containing fluid (such as air or any gas suitable for breathing) under super-atmospheric pressure for breathing. Straps typically hold the cylinder in place. The cylinders may be large and heavy, since they must contain enough breathing fluid under pressure to support the breathing of the user for some time. Such a harness is worn by the user in such a way that the heavy pressurised cylinder is carried on the user's back with a number of supports, such as shoulder straps and a waist belt ensuring that the harness, and therefore the cylinder, is held in place securely. The user wears a facemask, and a line conveys fluid from the cylinder to the facemask, with suitable regulation of the pressure, so that the user can breathe the fluid.

Such prior art harnesses are particularly useful for long duration, planned excursions into hazardous conditions, where a large, heavy cylinder of breathing gas is needed. However, there are circumstances in which a large, heavy, bulky cylinder is not necessary and in which, therefore, it is desirable to provide a smaller cylinder. In such cases a smaller, lighter harness is advantageous. For example, it may be desirable to provide a number of emergency sets of breathing apparatus, for use by personnel in case of a fire, or leak of hazardous chemicals, in a factory or manufacturing plant. In an emergency, the workers would enter a storage area, and put on a set of breathing apparatus. Clearly such action must be taken quickly, for the workers' safety, and therefore the harnesses must be easy to put on. Ideally, such harnesses should not be bulky so as to avoid taking up a large amount of storage space.

In another example, if the use of the breathing apparatus is planned but the foreseen usage time is relatively short, such as, for example, if an operative must use the apparatus whilst cleaning a chemical vat, it is unnecessary for the operative to wear an uncomfortable, rigid harness with a heavy long-duration cylinder mounted thereon. Furthermore, the user might be required to enter a relatively confined space, or negotiate an obstacle. In such cases a full-size cylinder mounted on a rigid harness might unduly hinder or prevent the operative's progress or even his escape.

In prior attempts to address such needs harnesses comprising a number of straps without a rigid plate have been proposed, for use with small cylinders. Such harnesses would be less heavy and cumbersome than the rigid harnesses discussed above, and would require less storage space. However, such prior harnesses as have been proposed are not without problems.

For example, it is not immediately obvious how to don a lightweight, flimsy harness, the various straps of which may be overlying each other, leaving the harness flat and shapeless in appearance. Time spent considering how to put on the harness might be better used effecting an escape.

BRIEF SUMMARY OF THE INVENTION

According to one aspect of the invention, there is provided a harness for use with breathing apparatus, the harness comprising at least one flexible panel, wherein the harness is arranged in use to be worn by a user of breathing apparatus and to adopt an operational configuration when so worn, and wherein the flexible panel is of material having resilient characteristics such that the harness at least partly retains its operational configuration whilst not in use.

Preferably the or each flexible panel is of a composite material which, in a preferred arrangement, comprises foam, which may be a closed-cell, open-face foam, such as compression-moulded EVA foam. The or each panel may comprise a sandwich construction, and optionally two layers of foam may enclose or encapsulate a layer of stiffer material therebetween. Alternatively a single layer of foam could be sandwiched between two layers of material.

Preferably, the harness comprises at least one such flexible panel which is arranged in use to be worn on a shoulder of a user.

The harness may comprise one or more securing straps and may include a belt portion, arranged in use to be worn on the waist of a user.

The harness may include a flexible mounting plate for receiving a cylinder of breathing gas. In a preferred arrangement, the mounting plate is of moulded material, and may be of plastics material.

The mounting plate may be moulded so as to include one or more recessed portions for receiving one or more components of breathing apparatus, such as a hose and/or a cylinder manifold.

In one arrangement, the harness may comprise one flexible panel arranged in use to pass around the wearer over one shoulder, in the manner of a bandolier, or sash.

In another, alternative arrangement, the harness may comprise one or more flexible panels arranged in use respectively to pass over the shoulders of the wearer in the manner of a backpack or rucksack.

According to another aspect of the invention there is provided a harness for use with breathing equipment, the harness comprising at least one shoulder support panel and a belt portion, the belt portion comprising attachment means for attaching a cylinder of breathable gas to the belt portion, the attachment means comprising mounting means arranged to releasably engage a mounting portion of a cylinder, and retaining means arranged to retain a retaining device for the cylinder, wherein, in use, a cylinder may be attached to the belt portion by both the mounting means and the retaining means or else by the retaining means alone.

In a preferred arrangement, when a cylinder is attached to the belt portion by both the mounting means and the retaining means, the cylinder and belt portion are juxtaposed in a first configuration, and when the cylinder is attached to the belt portion by only the retaining means the cylinder and belt portion are loosely attached in a second configuration.

In a particularly preferred arrangement, when, in use, the cylinder and belt portion are retained in the second configuration a user is able to move the cylinder freely about his person whilst retaining attachment to the cylinder by the retaining means.

Preferably the retaining means comprises one or more retaining straps. The retaining portion of the cylinder may comprise a web, holster or cradle for holding the cylinder.

Preferably the shoulder support panel is arranged in use to pass around a wearer over one shoulder in the manner of a bandolier or sash, and the belt portion is arranged in use to pass around the waist of the wearer.

In another aspect the invention provides a harness for carrying a cylinder of breathable fluid, the harness including a flexible hip-plate arranged for location on a hip of a wearer, and including at least two connectors for connecting a cylinder containing a fluid for breathing thereto, wherein a first connector is arranged for connecting a cylinder detachably, and a second connector is arranged for connecting the cylinder non-detachably, the detachable connector being arranged to hold the cylinder connected thereto in close proximity to the hip-plate, and the non-detachable connector being arranged to hold the cylinder connected thereto between the legs of a user when the detachable connector between the harness and the cylinder is detached.

The cylinder may have a manifold, in which the manifold includes a port for connecting a breathing-gas line from the cylinder to a facemask and in which the manifold further includes a connector for connecting the breathing apparatus to an additional fluid supply line. The invention may include any combination of the features or limitations referred to herein, except such features as are mutually exclusive.

BRIEF DESCRIPTIONS OF THE DRAWINGS

Preferred embodiments of the present invention will now be described, by way of example only, with reference to the accompanying drawings, in which.

DETAILED DESCRIPTION OF THE INVENTION

Figure 1:
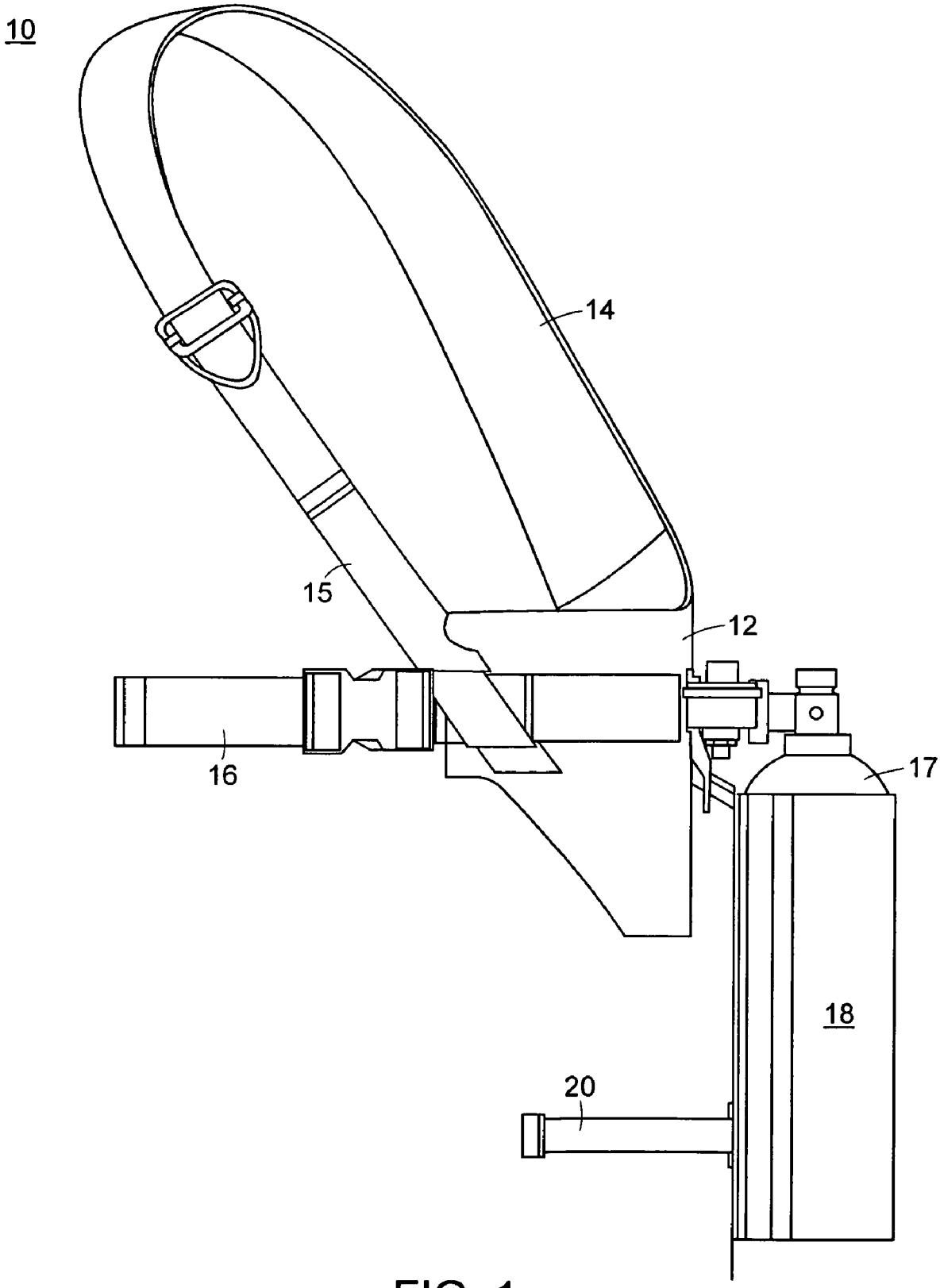
FIG. 1 is a front view of a first embodiment of harness.

Turning to FIG. 1, this shows generally at 10 a first embodiment of harness referred to hereinafter as a "hip-mount" harness. The harness has: a flexible hip plate 12 and a flexible bandolier-style shoulder panel 14, linked together by a strap 15, and a waist belt 16 fastenable by a sprung fastener. In use, the flexible hip plate 12 rests against the hip of a user (the left hip in this example), the waist belt is fitted around the waist of the user, and the shoulder panel 14 rests against the shoulder opposite to the hip against which the flexible plate is resting (the right shoulder in this example). The harness could, of course be configured as a mirror image of that shown in FIG. 1. A cylinder 17, containing breathing fluid at super-atmospheric pressure is attached to the flexible hip plate 12 of the harness in a manner to be described below in more detail. The cylinder 17 is retained in a fabric holster 18. In this example a further, optional strap 20 is provided on the harness 10 which strap is arranged to pass around the leg of the user. The strap 20 ensures that the holster 18 moves with the leg, and thus prevents the holster from swinging freely. All of the straps of the harness may be adjustable to accommodate differences in the sizes of different users. In one embodiment (not shown) the fabric holster may be pleated or otherwise expandable and may include an adjustable compression strap arranged to pass around a cylinder located in the holster. With such an arrangement, the holster can be adjusted to accommodate cylinders of different diameters.

At least the bandolier-style panel 14, and optionally also the hip plate 12 of the harness 10, are made of a resilient material which, though flexible, allows the harness substantially to retain its operational configuration even when not being worn. The material is preferably a composite, and may comprise closed cell, open face foam, such as compression moulded EVA foam. Two layers of such foam may be used in a sandwich construction, and may be glued or otherwise bonded together. Preferably, the material used is chosen to be inexpensive, fire-, chemical-, acid- and alkali-resistant, and has a good resistance to wear. The straps are preferably made of flame-retardant polyester.

Figure 2:
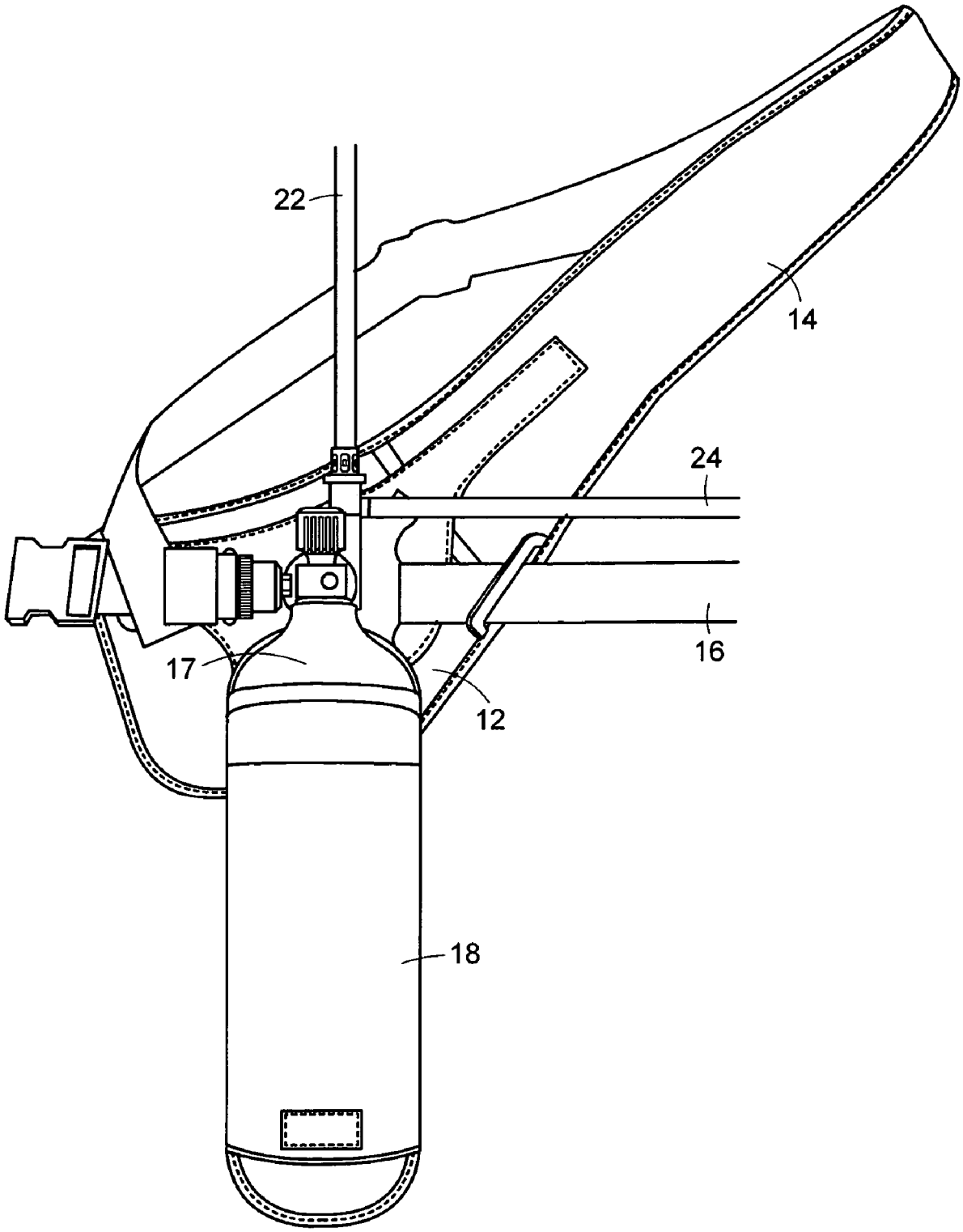
FIG. 2 is a side view of the harness of FIG. 1.

FIG. 2 shows the hip-mount harness 10 of FIG. 1 from the side. In this Figure a line 22 conveying fluid from the cylinder 17 to the mask (not shown) can be seen. An additional line 24 is shown which can be added optionally, and conveys fluid from a remote source to the harness. In such a case a remote source of breathing fluid may, for example, be stored in cylinders, on a trolley or frame, located outside the hazardous area. Alternatively, the breathing fluid may be from a factory "ring-main" source of breathing fluid. A line such as this allows the user of the breathing apparatus to draw his main air supply from a remote source with a small cylinder as a back-up for emergency and/or escape. This allows him to work in the hazardous area for longer, which may be especially useful to a person wearing a flexible harness according to this invention, which can typically only carry a relatively small cylinder. In a further arrangement (not shown in the drawings) a cylinder may not be needed; the operative may derive all of his air supply from the remote source. In this case, the air line from the remote supply would be fitted to the harness, and the air conveyed to the face mask of the operative.

Figure 3:
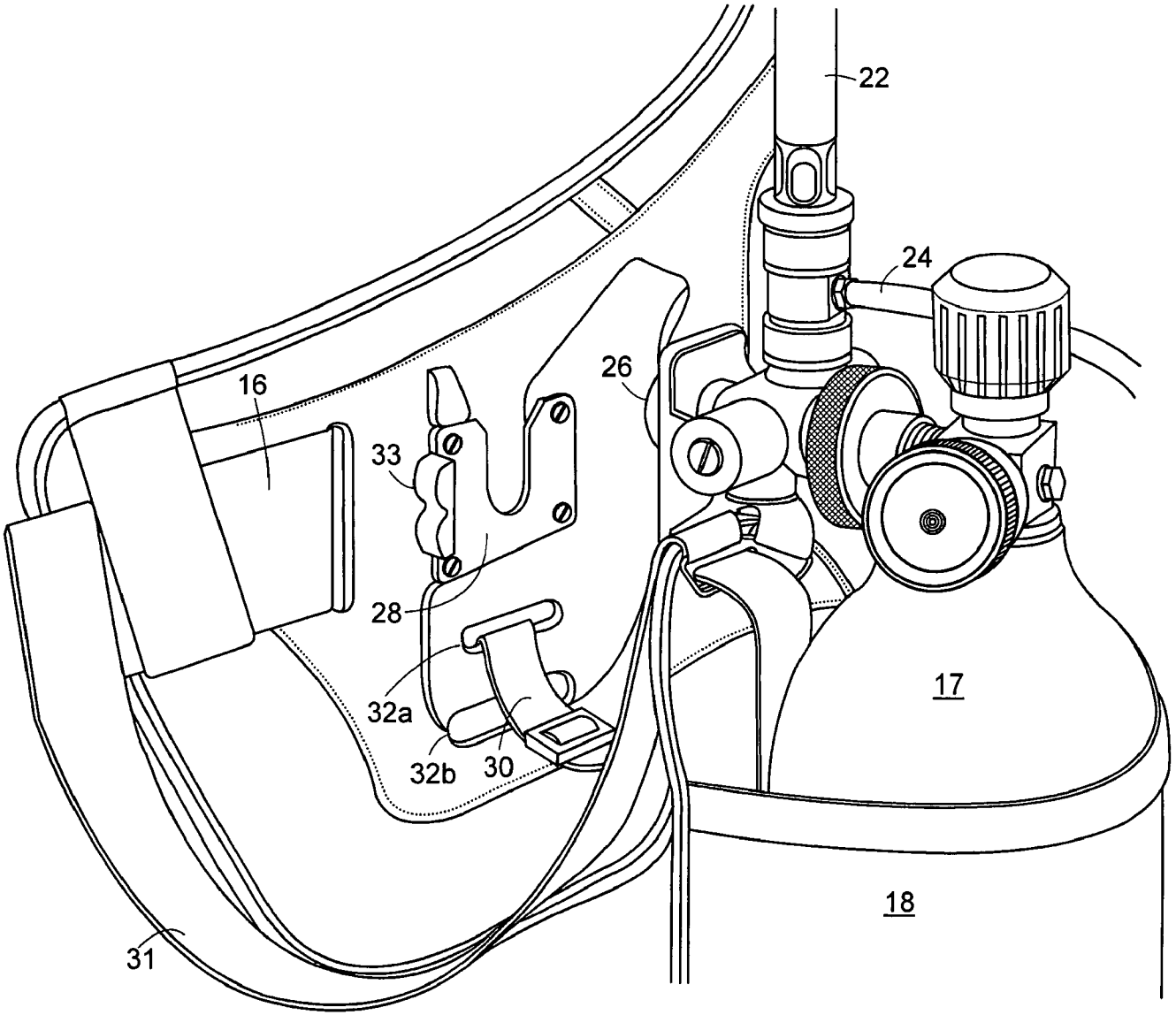
FIG. 3 shows the connection of a cylinder to harness of FIGS. 1 and 2.

FIG. 3 shows a close-up view of a cylinder 17 being attached to the flexible hip plate. In this case, the manifold of the cylinder 17 includes a lug 26, which can releasably locate in a corresponding U-shaped metal bracket 28 on the hip plate 12. Furthermore, the cylinder holster 18 includes straps 30, 31 which in use are threaded through two slots 32*a*, 32*b* below the U-shaped bracket 28, on the hip plate 12 and waist belt 16. With this embodiment, in the case that the user must pass through a narrow hole or space, the cylinder can be unclipped from its position on the hip of the wearer by depressing latch 33 and disengaging the lug 26 from the bracket 28, so that the cylinder 17 may swing down between the legs of the wearer. The cylinder is then retained in attachment with the harness by the straps 30, 31. When the user has overcome the obstacle, or passed though the narrow opening, the cylinder 17 can be re-clipped to the U-shaped bracket on the hip plate 12.

Figure 4:
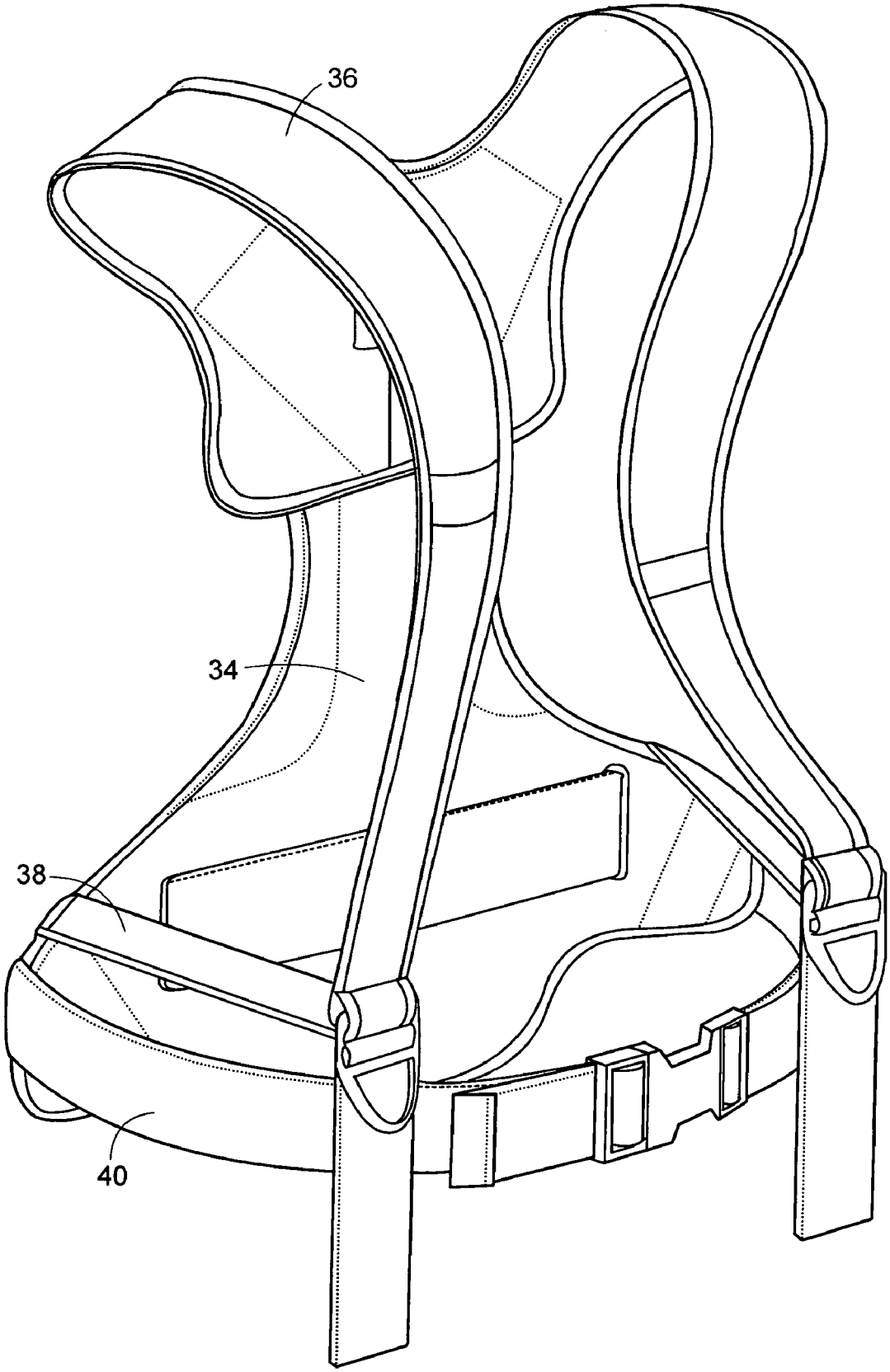
FIG. 4 is a front view of a second embodiment of harness.

FIG. 4 shows generally a further embodiment of harness referred to hereinafter as a "back-mount" harness. The harness has a flexible back plate 34, a shoulder panel 36, attached to straps 38, and a waist belt 40 fastenable by a sprung fastener. Again, the straps may be adjustable to accommodate different sizes of wearers. As with the first embodiment described above, at least the shoulder panel 36 may be of flexible resilient material to allow the harness to retain its operational configuration (as shown) even when it is not being worn. In addition to being flexible, which accommodates the wearer bending forwards, the back plate 34 may be articulated (i.e. so that the shoulder panel 36 and the back plate 34 are formed as two distinct plates that are pivotally mounted with respect to each other) to allow greater freedom of side-to-side movement of the wearer. Again, the back plate 34 and shoulder panel may be made of EVA foam, and the straps 38 of polyester.

Figure 5:
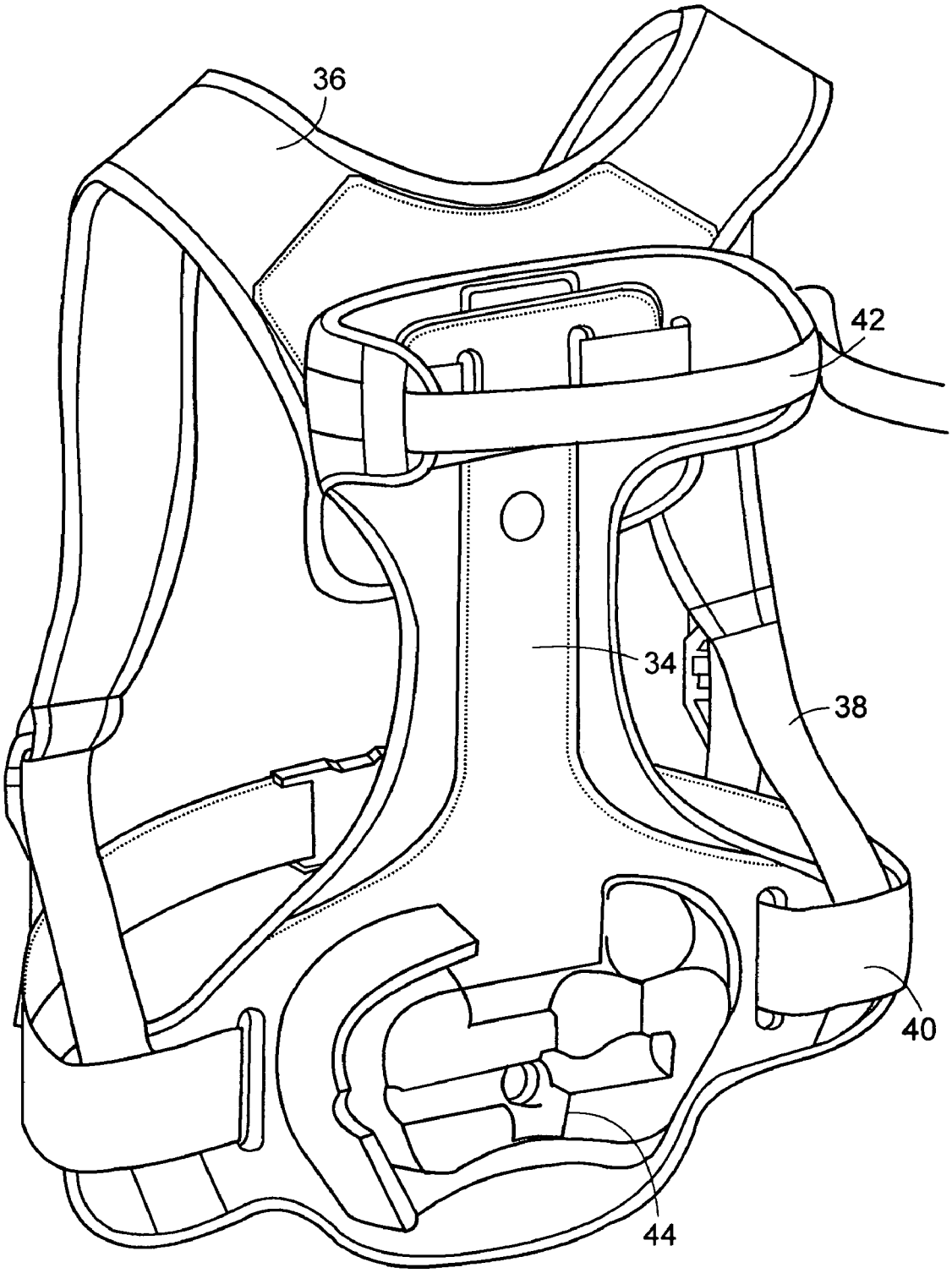
FIG. 5 is a back view of the harness of FIG. 4.

FIG. 5 shows a back view of the harness shown in FIG. 4. The flexible back plate 34 can be seen in more detail from this Figure. A retaining strap 42 is provided to secure a cylinder (not shown) to the harness. The cylinder may optionally be provided with a protective fabric cover (not shown).

The waist belt 40 threads through the back plate 34 and attaches to the shoulder adjusting straps 38, in the manner of a back-pack or rucksack. The back plate 34 itself includes a moulded plastics portion 44 which is shaped to receive parts of the cylinder, such as the manifold, and associated apparatus, such as a breathing line, so that these are accommodated as intimately as possible in the harness and, as a result, the risk of snagging is minimised.

Thus, embodiments of the invention described above provide a lightweight flexible harness for use with breathing apparatus in which comfort and ease of use are improved.

The invention claimed is:

1. A harness for use with breathing equipment, the harness comprising at least one shoulder support panel; and a belt portion, the belt portion comprising attachment means for attaching a cylinder of breathable gas to the belt portion, the attachment means comprising mounting means for releasably engaging a mounting portion of the cylinder, and retaining means for retaining a retaining device for the cylinder, wherein the cylinder may be attached to the belt portion such that, without disruption of the breathable gas, the cylinder may be alternated between first and second configurations second configurations, wherein in the first configuration the cylinder is attached to the belt portion by both the mounting means and the retaining means, and wherein in the second configuration the cylinder is attached to the belt portion by the retaining means alone, and wherein the shoulder support panel is adapted to be arranged in use to pass around a wearer over one shoulder in the manner of a bandolier or sash, and the belt portion is adapted to be arranged in use to pass around the waist of the wearer.

2. A harness according to claim 1, wherein the mounting means includes a flexible mounting plate for receiving a cylinder of breathing gas.

3. A harness according to claim 2, wherein the mounting plate is of moulded material.

4. A harness according to claim 2, wherein the mounting plate is moulded so as to include one or more recessed portions for receiving one or more components of breathing apparatus.

5. A harness according to claim 2, wherein the shoulder panel is flexible and wherein the shoulder panel and mounting plate are of a composite material.

6. A harness according to claim 5, wherein the composite material comprises foam, which may be a closed-cell, open-face foam, such as compression-moulded EVA foam.

7. A harness according to claim 2, wherein the shoulder panel and mounting plate comprise a sandwich construction.

8. A harness according to claim 7, wherein shoulder panel and mounting plate comprise two layers of foam enclosing or encapsulating a layer of stiffer material therebetween.

9. A harness according to claim 2, wherein the shoulder panel and mounting plate comprises a single layer of foam sandwiched between two layers of stiffer material.

10. A harness according to claim 1, wherein when a cylinder is attached to the belt portion by both the mounting means and the retaining means, the cylinder and belt portion are juxtaposed in the first configuration, and when the cylinder is attached to the belt portion by only the retaining means, the cylinder and belt portion are loosely attached in the second configuration.

11. A harness according to claim 1, wherein when, in use, the cylinder and belt portion are retained in the second configuration a user is able to move the cylinder freely about his person whilst retaining attachment to the cylinder by the retaining means.

12. A harness according to claim 1, wherein the retaining means comprises one or more retaining straps and the retaining portion of the cylinder comprises a web, holster or cradle for holding the cylinder.

13. A harness according to claim 1, wherein the belt portion includes a flexible hip-plate arranged for location on a hip of a wearer, and at least two connectors for connecting the cylinder of breathable gas thereto, wherein a first connector is arranged for connecting the cylinder detachably, a second connector is arranged for connecting the cylinder non-detachably, the detachable connector being arranged to hold the cylinder connected thereto in close proximity to the hip-plate, and the non-detachable connector being arranged to hold the cylinder connected thereto between the legs of a user when the detachable connector between the harness and the cylinder is detached.

14. A harness according to claim 13, wherein the cylinder has a manifold, in which the manifold includes a port for connecting a breathing-gas line from the cylinder to a face mask and in which the manifold further includes a connector for connecting the breathing apparatus to an additional fluid supply line.

15. A harness for use with breathing equipment, the harness comprising at least one shoulder support panel adapted to be arranged in use to pass around a wearer over one shoulder in the manner of a bandolier or sash; and a belt portion adapted to be arranged in use to pass around the waist of the wearer, the belt portion comprising, attachment means for attaching a cylinder of breathable gas to the belt portion, the attachment means comprising mounting means for releasably engaging a mounting portion of the cylinder, and a retaining strap coupled to the cylinder, the retaining strap extendable to remaining coupled to the cylinder without disruption of breathable gas when both the mounting portion of the cylinder is disengaged from the mounting means and the cylinder is displaced to a location remote from the belt portion of the harness.

* * * * *

UNITED STATES PATENT AND TRADEMARK OFFICE

CERTIFICATE OF CORRECTION

PATENT NO. : 7,726,312 B2
APPLICATION NO. : 10/812495
DATED : June 1, 2010
INVENTOR(S) : Aaron Chapman et al.

It is certified that error appears in the above-identified patent and that said Letters Patent is hereby corrected as shown below:

In Col. 5, line 30
please delete "second configurations".

Signed and Sealed this

Seventeenth Day of August, 2010

David J. Kappos

David J. Kappos
*Director of the United States Patent and Trademark Office*